US011147384B1

(12) United States Patent
Lopez Ramirez

(10) Patent No.: US 11,147,384 B1
(45) Date of Patent: Oct. 19, 2021

(54) DYNAMIC PRIVACY BARRIER SYSTEM

(71) Applicant: INDUSTRIAS NORTECAUCANAS S.A.S., Cali (CO)

(72) Inventor: Guillermo Enrique Lopez Ramirez, Cali (CO)

(73) Assignee: INDUSTRIAS NORTECAUCANAS S.A.S., Cali (CO)

( * ) Notice: Subject to any disclaimer, the term of this patent is extended or adjusted under 35 U.S.C. 154(b) by 0 days.

(21) Appl. No.: 17/038,997

(22) Filed: Sep. 30, 2020

(51) Int. Cl.
*A47C 7/62* (2006.01)
*A47C 1/12* (2006.01)

(52) U.S. Cl.
CPC . *A47C 7/62* (2013.01); *A47C 1/12* (2013.01)

(58) Field of Classification Search
CPC ..... B64D 11/0606; B64D 11/06; B60N 2/91; A47C 7/62; A47C 1/12
See application file for complete search history.

(56) References Cited

U.S. PATENT DOCUMENTS 5,024,398 A * 6/1991 Riedinger ..... B64D 11/0015 244/118.5
6,347,590 B1 * 2/2002 D'Annunzio ..... B60N 3/002 108/25
6,644,736 B2 * 11/2003 Nguyen ..... B64D 11/0606 297/184.17
7,178,871 B1 2/2007 Round et al.
7,568,759 B2 * 8/2009 Schurg ..... B64D 11/0644 297/184.1
9,216,674 B1 12/2015 Garib
9,266,447 B2 * 2/2016 Buehlmeyer ..... B60N 2/38
9,434,282 B2 9/2016 Kronenberger
10,046,685 B1 8/2018 Bryant et al.
10,494,101 B2 * 12/2019 Wilson ..... B60N 2/809
10,696,187 B2 * 6/2020 Lalague ..... B60R 21/026
10,737,790 B1 * 8/2020 Cabrita ..... B60N 2/90
10,752,196 B2 * 8/2020 Lalague ..... B62D 33/042
10,800,305 B2 * 10/2020 Garcia Sanchez ..... B60Q 3/20
10,934,002 B2 * 3/2021 Boddu ..... B64D 11/0644
2001/0000639 A1 * 5/2001 Park ..... B60N 2/0224 297/411.3
2001/0003962 A1 * 6/2001 Park ..... B64D 11/0601 108/140
2005/0194827 A1 * 9/2005 Dowty ..... B60N 2/643 297/411.3
2007/0085389 A1 * 4/2007 Schurg ..... B64D 11/0644 297/184.1
2008/0252109 A1 * 10/2008 Salzer ..... B60N 3/002 297/173
2008/0265638 A1 * 10/2008 Strasser ..... B64D 11/0644 297/217.1

(Continued)

*Primary Examiner* — Shin H Kim
(74) *Attorney, Agent, or Firm* — Hoglund & Pamias, PSC; Roberto J. Rios

(57) ABSTRACT

A movable or pivoting privacy barrier is provided inside the side panels of a cinema seat for selectively providing privacy to the user, with the option of allowing a user to decide whether not to use the privacy barrier. The dynamic privacy barrier system of the includes a privacy barrier that is part and provided inside of the seat support, so that the privacy barrier is pivoted inside the seat support to retract or store the component. The proposed system provides an enhanced privacy experience without affecting the aesthetic appearance of the seat or the environment where it is installed.

19 Claims, 8 Drawing Sheets

(56) References Cited

U.S. PATENT DOCUMENTS

| | | | | |
|---|---|---|---|---|
| 2015/0013737 | A1 | 1/2015 | Daly | |
| 2015/0108814 | A1* | 4/2015 | Meister | B64D 11/0646 297/391 |
| 2016/0355109 | A1* | 12/2016 | Geraty | B60N 2/90 |
| 2018/0312082 | A1* | 11/2018 | Lalague | B60N 2/91 |
| 2018/0312127 | A1* | 11/2018 | Lalague | B62D 33/046 |
| 2019/0061955 | A1* | 2/2019 | Wilson | B60N 2/879 |
| 2019/0143857 | A1* | 5/2019 | O'Hara | B60N 2/5621 297/180.13 |
| 2019/0152371 | A1 | 5/2019 | Carlson | |
| 2019/0217957 | A1* | 7/2019 | Wilson | B60N 2/885 |
| 2019/0359338 | A1 | 11/2019 | Colletti | |
| 2020/0055436 | A1* | 2/2020 | Garcia Sanchez | B60N 2/91 |
| 2020/0262562 | A1* | 8/2020 | Dowty | B64C 1/1423 |

* cited by examiner

DYNAMIC PRIVACY BARRIER SYSTEM

FIELD OF THE INVENTION

The present invention relates to a privacy seating arrangement. More specifically, relates to a seating arrangement having privacy barriers that are actuated by a user to ensure privacy between adjacent seats.

BACKGROUND OF THE INVENTION

There is a current need to increase privacy features for people seating on cinema seats during a film presentation. Privacy barriers have been proposed in the past to address this situation but unfortunately the prior implementations have failed to completely address people's concerns and interests.

For example, it has been identified that not all people who make use of the seat armrest for cinemas wish to have privacy barriers. Accordingly, there is a long felt need of a system that could fulfill the conditions and requirements of the market and provide a dynamic privacy barrier system integral to the cinema seat.

SUMMARY OF THE INVENTION

The present invention proposes a movable or pivoting barrier provided inside the side panels of a cinema seat in order to provide privacy to the user, with the option of allowing a user to decide whether not to use the privacy barrier should the user considers it appropriate.

The system of the present invention addresses the above-explained deficiencies without affecting the aesthetic appearance of the seat or the environment where it is installed.

The dynamic privacy barrier system of the present invention includes a component, that is part of the seat support (panel or side support box), that by means of a pivot or shaft arrangement rotates inside the panel or side support box to retract or store the component.

This component is manipulated by a user to selectively provide privacy or to keep it in place. The component being integrated into the seat maintaining the aesthetics aspect of the seat.

According to an aspect of the invention, a pivoting system is used to provide the rotational movement needed for the privacy barrier.

According to another aspect of the invention, a detent element is provided to ensure that the privacy barrier is stopped before being completely retracted from the side panel.

According to yet another aspect of the invention, a latching mechanism is provided so that the user can manually locked in place the retracted privacy barrier and to allow ease of storage should the user decide to have no further privacy.

BRIEF DESCRIPTION OF THE DRAWINGS

Further features and advantages of the invention will become apparent from the following detailed description taken in conjunction with the accompanying figures showing illustrative embodiments of the invention, in which.

Throughout the figures, the same reference numbers and characters, unless otherwise stated, are used to denote like elements, components, portions or features of the illustrated embodiments. The subject invention will be described in detail in conjunction with the accompanying figures, in view of the illustrative embodiments.

DETAILED DESCRIPTION OF THE INVENTION

A preferred embodiment of the invention is implemented as illustrated in FIGS. 1-5. A movie theater seat arrangement 1 includes a pair of seats, where each seat has a back portion 1*a* coupled to a seat portion 1*b*, which in turn is coupled to a retractable foot portion 1*c*. The seats are positioned side-by-side and are separated by a center panel 2*b* that contains a central armrest portion 3 at the top of the center panel 2*b*. According to an embodiment, the armrest portion 3 includes a storage area so that a person can store personal items and can also include a cup holder 3*a*. The left seat is provided with a left side panel 2*a* and the right seat is also provided with a right side panel 2*c*. Preferably, each seat is provided with a tray 4*a* having a rotating mechanism 4*b* so that a person can selectively move the tray 4*a* towards the seat and away from the seat when sitting down, when placing food over the tray or while watching a film. When the tray 4*a* is provided, the rotating mechanism 4*b* can include a hollow area configured as a cup holder. Alternatively, one or both seats of the seat arrangement 1 can be provided without the tray 4*a*, where the hollow area configured as a cup holder can still be provided on the side panels 2*a*, 2*c*. According to an embodiment of the invention, the panels 2*a*, 2*b*, and 2*c* are made of a rigid material such as but not limited to metal, wood, plastic or combinations thereof.

Figure 1:
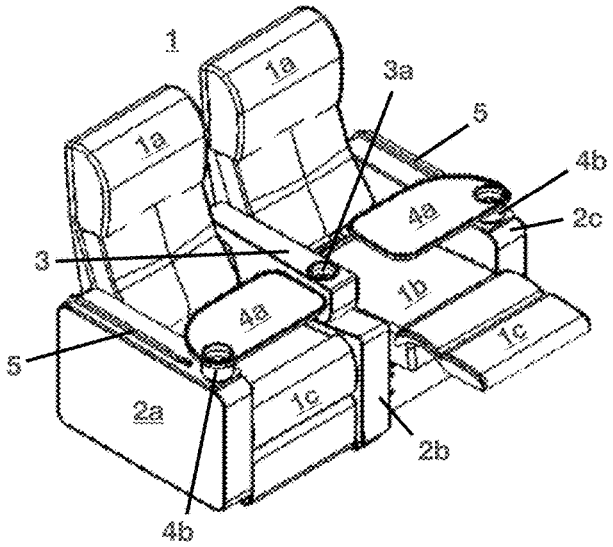
FIG. 1 shows a seat arrangement 1 including a pair of seats, according to the present invention.
Figure 2:
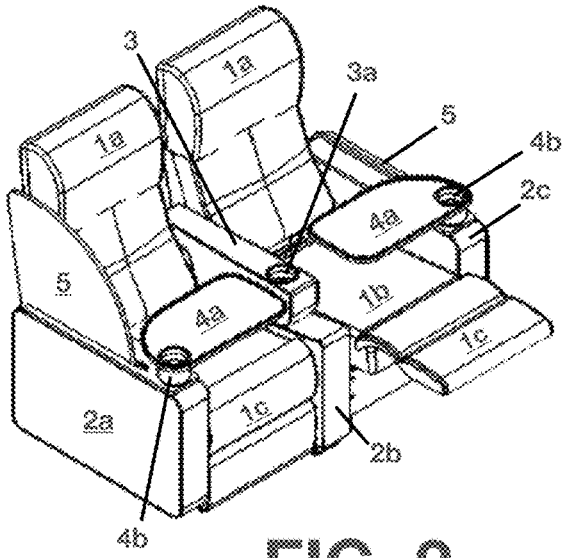
FIG. 2 shows a seat arrangement 1 with a left privacy barrier retracted, according to the present invention.
Figure 3:
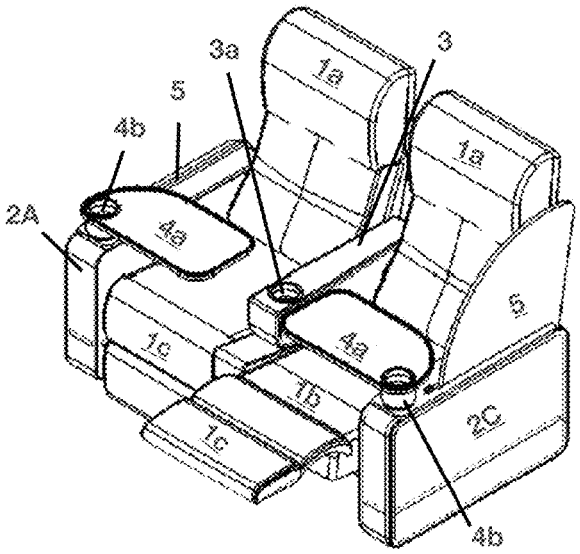
FIG. 3 shows a seat arrangement 1 with a right privacy barrier retracted, according to the present invention.
Figure 4:
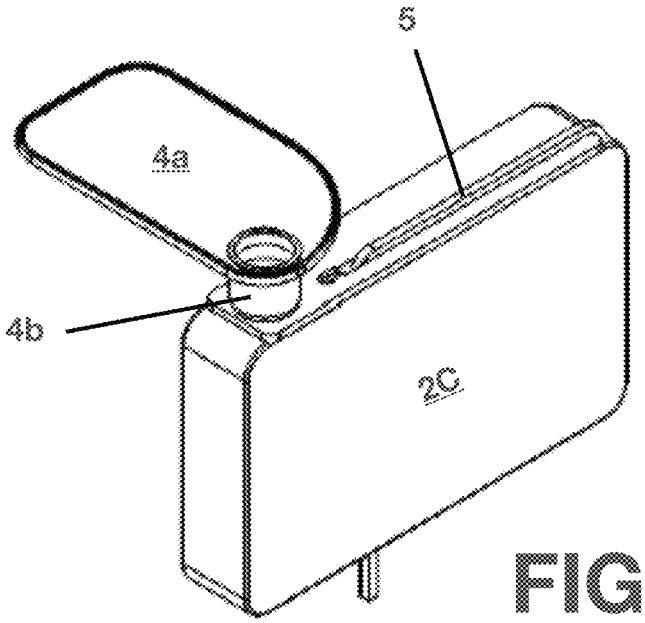
FIG. 4 shows a perspective view of a seat side panel with a privacy barrier stored, according to the present invention.
Figure 5:
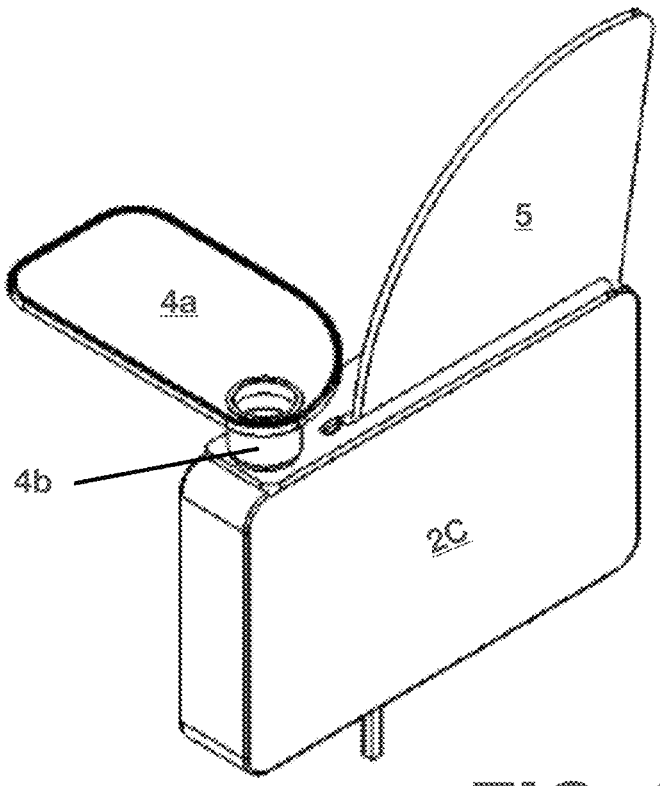
FIG. 5 shows a perspective view of a seat side panel with a privacy barrier retracted, according to the present invention.

As shown in FIG. 1, the seat arrangement 1 is provided with privacy retractable barriers 5 that are located inside each side panels 2*a*, 2*c*. A person can selectively retract the retractable barriers 5 out of the side panels 2*a*, 2*c*, as shown in FIG. 2 and FIG. 3. An exemplary side panel 2*c* is shown in FIG. 4 and FIG. 5, to illustrate the retractable barrier 5 inside and outside the side panels 2*a*, 2*c*. While the preferred embodiment provides the retractable barrier 5 inside the side panel 2*a*, 2*c*, it is to be understood the retractable barrier 5 can also be provided inside the center panel 2*b* and can be operated the same way as the retractable barrier 5 of the side panels 2*a*, 2*c*. It is also envisioned, that the retractable barrier 5 can be provided: 1) on only one of the side panels, 2) on both side panels, 3) on only the center panel 2*b*, 4) on one side panel and the center panel, or 5) on both side panels and the center panel 2*b*. When provided on the center panel 2*b*, it is also envisioned that two retractable barriers 5 can be provided on the center panel, one barrier 5 facing a left seat and the other barrier 5 facing a right seat.

Figure 6:
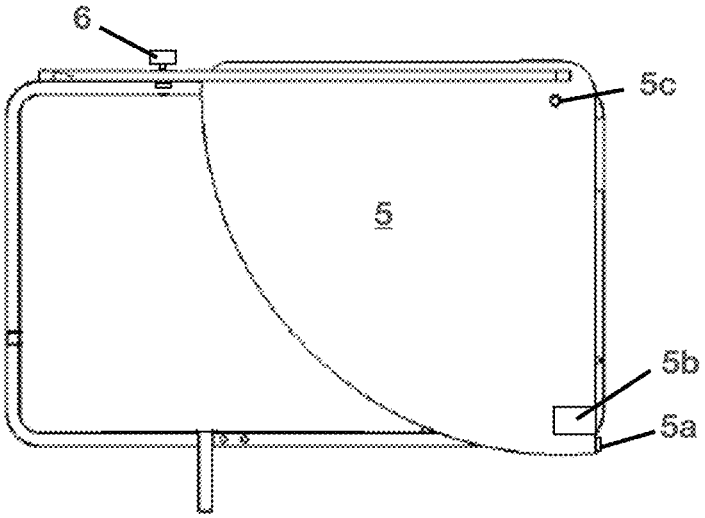
FIG. 6 shows a cross-sectional side view of a seat side panel with a privacy barrier stored, according to the present invention.
Figure 9:
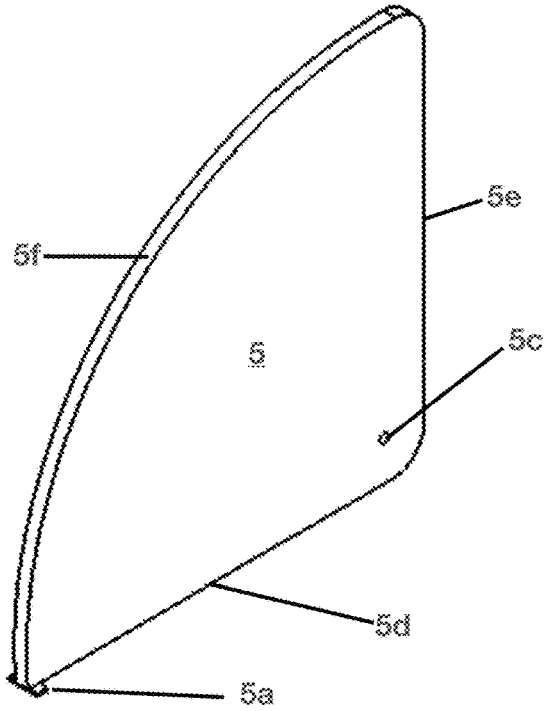
FIG. 9 shows a perspective view of a privacy retractable barrier, according to the present invention.
Figure 10:
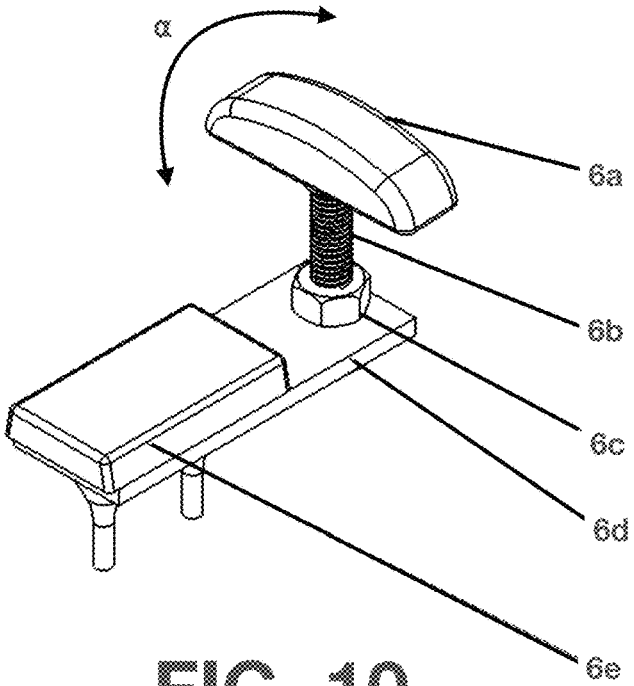
FIG. 10 shows a perspective view of a latching mechanism, according to the present invention.

According to an embodiment of the invention, the retractable barrier 5 is a flat surface element defined by a first linear side 5*d*, a second linear side 5*e* perpendicular to the first linear side 5*d*, and a curved side 5*f* extending between distal ends of the first linear side 5*d* and second linear side 5*e*, respectively (FIG. 9). The retractable barrier 5 can be made of at least one of: wood, lightweight wood, triplex wood, plastic or combinations thereof, with or without a post forming finish allowing the user to generate privacy when desired. The retractable barrier 5 can be manually retracted from the side panel until reaching a privacy position outside the side panel (FIG. 5, FIG. 7) or returned back into a stored position inside the side panel (FIG. 4, FIG. 6). This is achieved by a pivoting arrangement 5*c* between the retractable barrier 5 and the side panel. According to an embodiment, a passthrough hole is provided on the retractable barrier 5 and at least one pin is provided on the inner walls of the side panel so that the at least one pin slidably engages said passthrough hole allowing the retractable barrier 5 to pivot around an axis defined by said pin when a user moves the retractable barrier 5. Alternatively, at least one pin can be provided on the retractable barrier 5, so that said at least one pin engages at least one receiving element (such as but not limited to an opening or cavity) provided on the inner walls of the side panel allowing the retractable barrier 5 to pivot around an axis defined by said pin when a user moves the retractable barrier 5. In accordance with an embodiment of the invention, the retractable barrier 5 rotates from 0° (retracted) to 100° (extracted).

Figure 7:
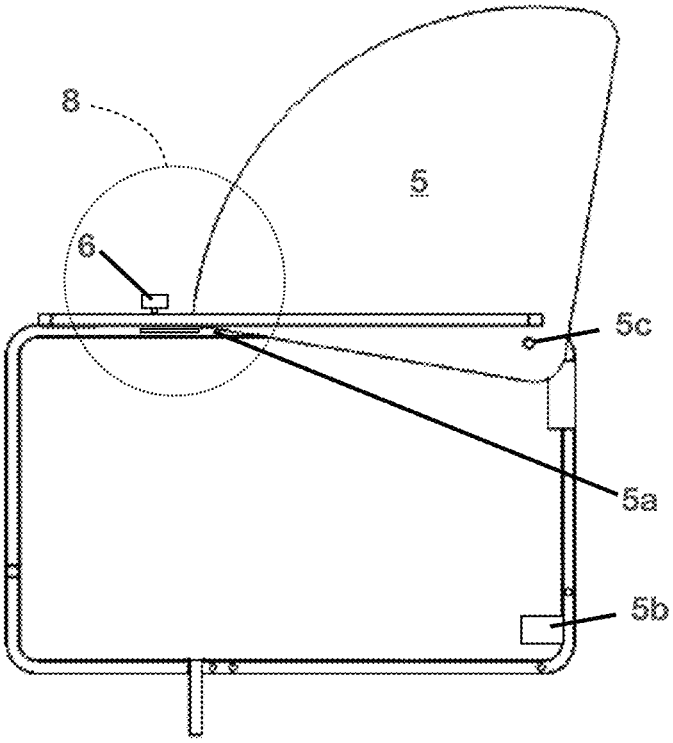
FIG. 7 shows a cross-sectional side view of a seat side panel with a privacy barrier retracted, according to the present invention.
Figure 8:
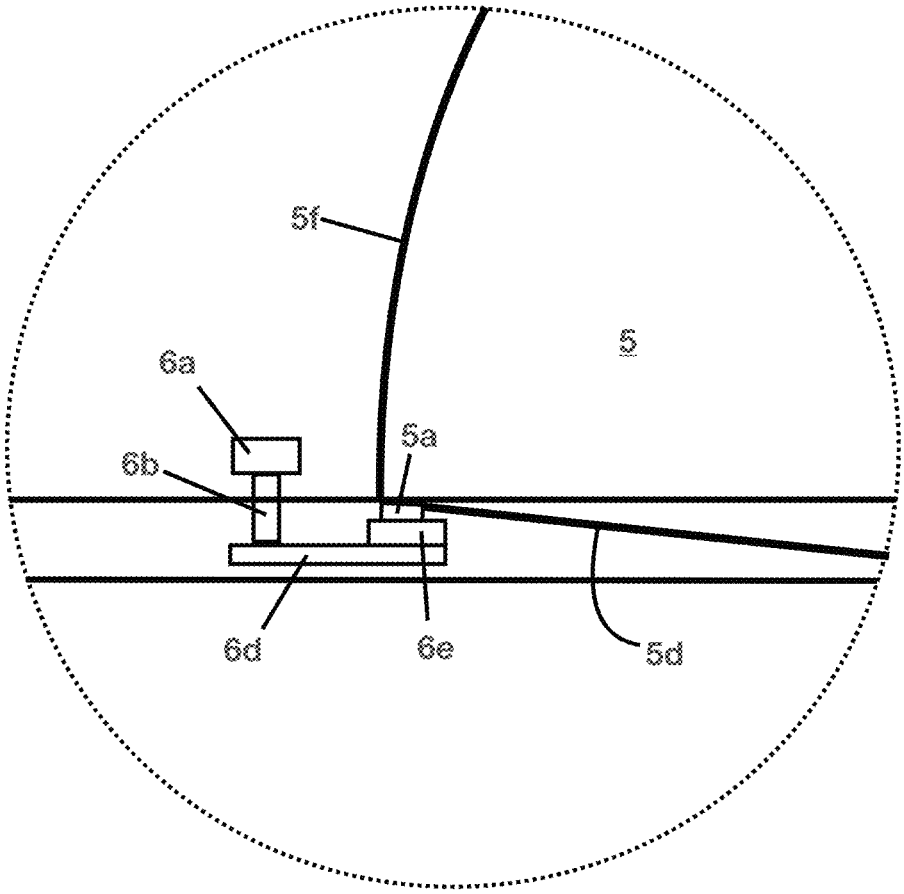
FIG. 8 shows a portion of a view illustrated on FIG. 7 enlarged for magnification purposes.

FIG. 6 and FIG. 7, show a side panel without a side cover for clarity purposes. The retractable barriers 5 is positioned inside the side panel, wherein the retractable barrier 5 is coupled to the side panel via the pivoting arrangement 5*c*. When the retractable barrier 5 is inside the side panel, it is retained in place and aligned with respect to an upper opening 5*g* by means of a receiving rail 5*b* that is provided on an inner wall of the side panel as shown in FIGS. 6, 7, 11, 12. The receiving rail 5*b* has a U-shape form configured to enclosed a portion of the side 5*d* when the retractable barrier 5 is on the stored position inside the side panel. In addition, the retractable barrier 5 is provided with a detent 5*a* located at the distal end of side 5*d* adjacent to an end of the curved side 5*f* (FIGS. 7-9). As will be explained later, the detent 5*a* rests against the bottom of the upper opening 5*g* preventing the retractable barrier 5 from being completely retracted out of the side panel. Once a user retracts the barrier 5 to its privacy position outside the side panel, the user operates a latching mechanism 6 that engages side 5*d* of the retractable barrier 5 in order to lock the retractable barrier 5 in place.

Figure 13:
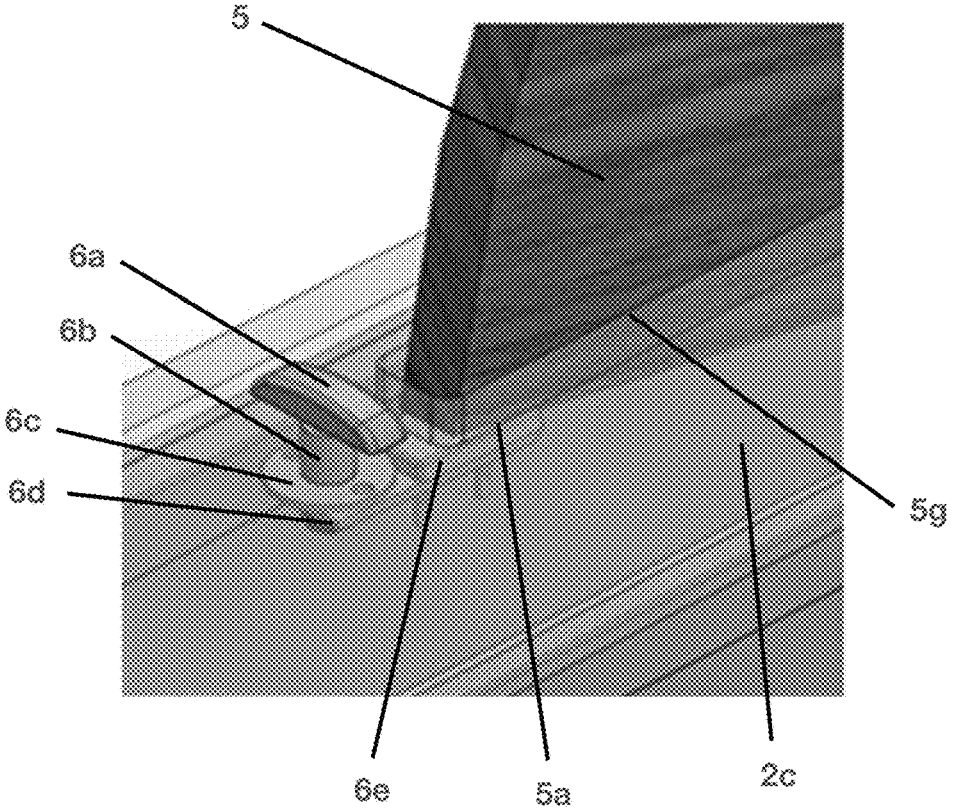
FIG. 13 illustrates a privacy barrier retracted and a latching mechanism, according to the present invention.
Figure 14:
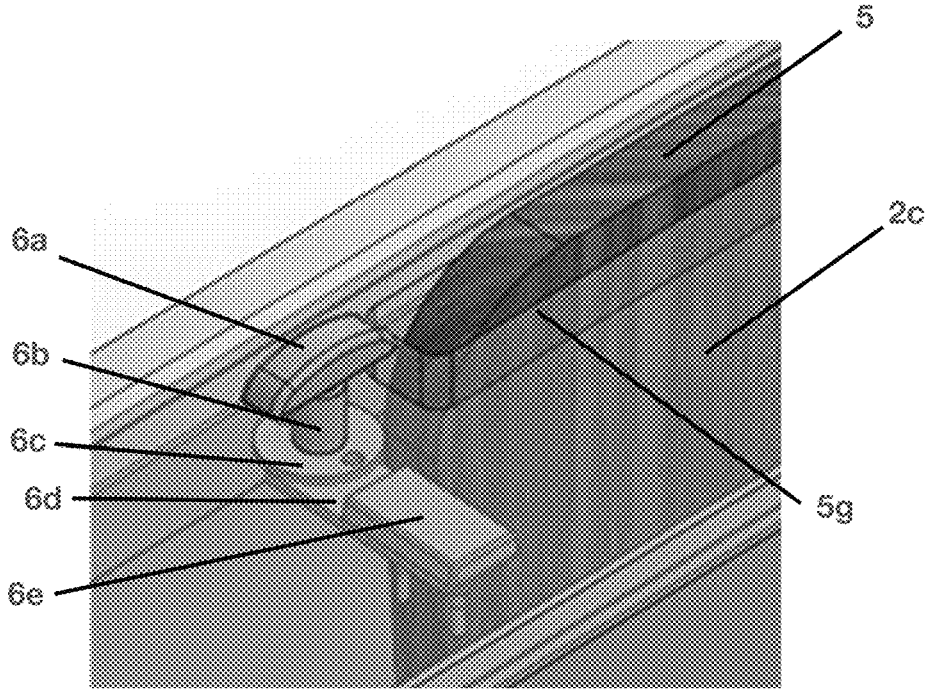
FIG. 14 illustrates a privacy barrier stored and a latching mechanism, according to the present invention.

As can be appreciated from FIGS. 8, 13, 14, the latching mechanism 6 includes a support base 6*d* carrying a latching detent 6*e* at a distal end and a handle 6*a* at a proximal end. In a preferred embodiment, the latching detent 6*e* is made of a flexible and resilient material, such as but not limited to rubber. However, other materials can be used including without limitation, plastic, wood, metal or combinations thereof or any flexible or rigid material. In addition, according to a preferred embodiment, the handle 6*a* is made from a rigid material such as but not limited to metal, plastic, wood or combinations thereof.

According to an embodiment of the invention, the handle 6*a* is coupled to the support base 6*d* by means of a threaded element 6*b* having an end coupled to said handle 6*a* and another end engaged to a nut element 6*c* provided on said support base 6*d*. However, it is also envisioned that other non-threaded elements can be used to couple the handle 6*a* to the support base 6*d*. For example, the handle 6*a*, and the threaded element 6*b* and support base 6*d* can be provided together as a single piece latching mechanism 6. It is important to note, that regardless of the embodiment, the handle 6*a* will always be positioned outside and above the top surface of the side panel, wherein the threaded element 6*b*, the nut element 6*c*, the support base 6*d* and the latching detent 6*e* always remain positioned inside and bellow the top surface of the side panel as shown in FIGS. 8, 13, 14.

In operation, when a user desires to operate the retractable privacy barrier 5, the user grabs an upper portion of the retractable barrier 5 lying outside the side panel and pulls the retractable barrier 5 out of the side panel in an upward direction. According to another embodiment of the invention, a grabbing portion such as but not limited to a protruding tab or an indented cavity can be provided on said upper portion of the retractable barrier 5 so that the user grabs the retractable barrier 5 at the protruding tab/indented cavity and pulls/push the retractable barrier 5 in and out of the side panel by means of the protruding tab/indented cavity.

Figure 11:
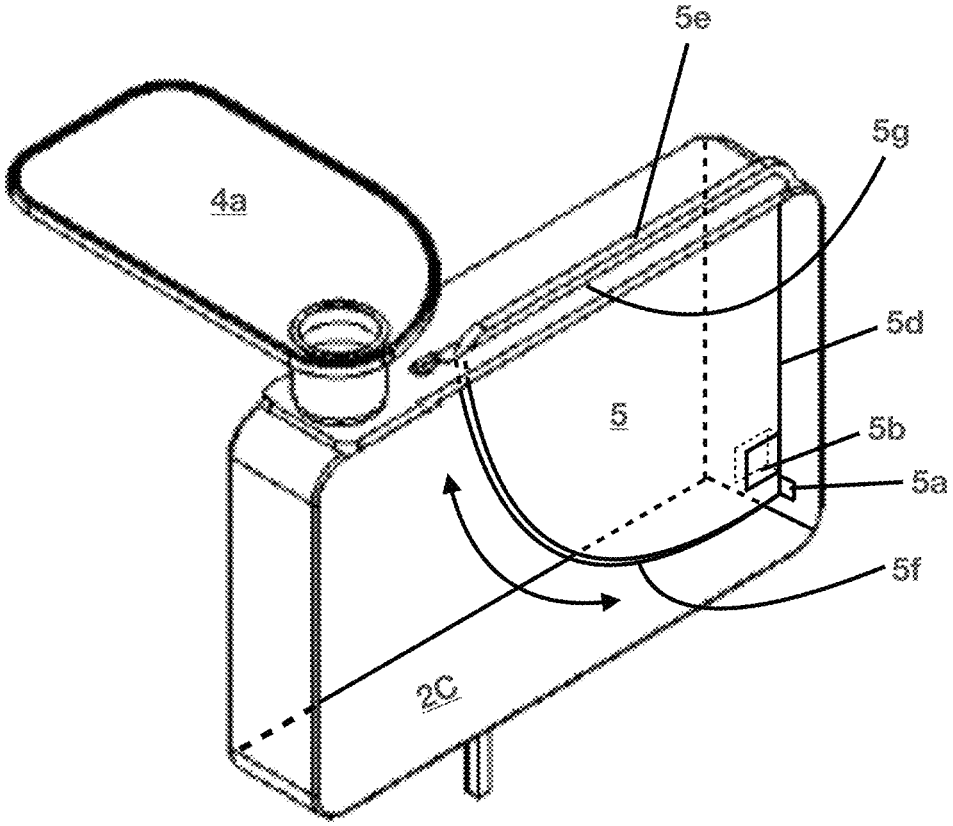
FIG. 11 shows a perspective view of a seat side panel without a side cover having a privacy barrier stored, according to the present invention.
Figure 12:
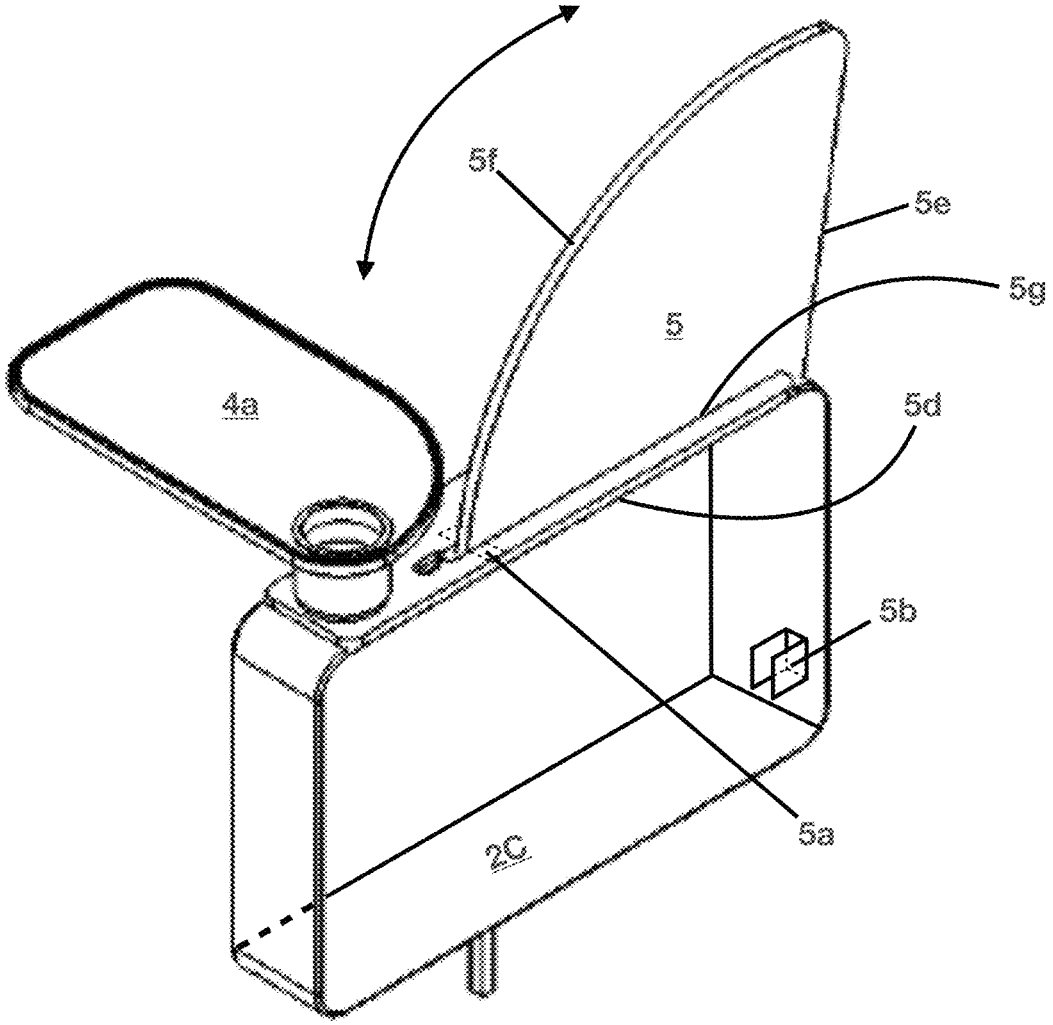
FIG. 12 shows a perspective view of a seat side panel without a side cover having a privacy barrier retracted, according to the present invention.

This upward movement causes the retractable barrier 5 to pivot around its rotating axis 5*c* so that the barrier 5 is retracted from its stored position into its privacy position (FIGS. 11, 12). As the retractable barrier 5 is moving towards the privacy position, the retractable barrier 5 continues sliding through the upper opening 5*g* until the detent 5*a* abuts against the bottom of the upper opening 5*g* and the retractable barrier 5 cannot be moved any longer. At that time, the user rotates the handle 6*a* so that the latching detent 6*e* engages the detent 5*a* of the retractable barrier 5 and locks the retractable barrier 5 in place on the privacy position (FIGS. 8, 13). The handle 6*a* is horizontally rotated an angle $\alpha$ from a position where the support base 6*d* is out of the movement path of said retractable barrier 5 (FIG. 14) into a position where the support base 6*d* and the latching detent 6*e* are in the movement path of said retractable barrier 5 (FIG. 13). In a preferred embodiment, the handle 6*a* is horizontally rotated 90°. However, other angular ranges or limits can be used as long as the support base 6*d* can move from an unblocking to a blocking position with respect to the movement path of said retractable barrier 5.

As can be appreciated from FIG. 13, when the retractable barrier 5 is locked on the privacy position, the support base 6*d* and the latching detent 6*e* are substantially parallel under the side 5*d* of the retractable barrier 5 so that the detent 5*a* is held and abutted against the latching detent 6*e*. It is also envisioned, that the detent 5*a* can be positioned away from the distal end of the side 5*d* of the retractable barrier 5 so that the distal end of the side 5*d* is directly held and abutted against the latching detent 6*e* instead of the detent 5*a*. In such case, it is important to position the detent 5*a* on the side 5*d* at a location that would not interfere operation and would not prevent the retractable barrier 5 to be received inside the receiving rail 5*b*. This can be ensured by positioning the detent 5*a* at a location that lies above or below the receiving rail 5*b* when the retractable barrier 5 is moved into the stored position inside the side panel.

Although the present invention has been described herein with reference to the foregoing exemplary embodiment, this embodiment does not serve to limit the scope of the present invention. Accordingly, those skilled in the art to which the present invention pertains will appreciate that various modifications are possible, without departing from the technical spirit of the present invention.

The invention claimed is:

1. A dynamic privacy barrier system for a seat comprising:

a side panel coupled to a side of the seat;

a privacy barrier positioned inside the side panel, said privacy barrier having a pivoting arrangement coupled to an interior wall of said side panel;

a latching mechanism coupled to said side panel, wherein said privacy barrier is locked at a retracted position by said latching mechanism once the privacy barrier is pivotally moved out of said side panel; and a detent provided at an edge of said privacy barrier so that the pivotal movement of said privacy barrier is stopped once said detent abuts against an upper portion of said side panel.

2. The dynamic privacy barrier system according to claim 1, wherein said latching mechanism comprises a handle coupled to a supporting base that supports a latching detent.

3. The dynamic privacy barrier system according to claim 2, wherein said handle is provided outside said side panel and the supporting base and the latching detent are provided inside said side panel.

4. The dynamic privacy barrier system according to claim 1, wherein said privacy barrier slides through an upper opening provided on a top of said side panel when being pivotally moved.

5. The dynamic privacy barrier system according to claim 1, wherein said privacy barrier comprises a flat surface element defined by a first linear side, a second liner side perpendicular to the first linear side, and a curved side extending between distal ends of the first linear side and second linear side, respectively.

6. The dynamic privacy barrier system according to claim 1, further comprising a U-shaped rail positioned on the interior of said side panel.

7. The dynamic privacy barrier system according to claim 6, wherein a linear side of said privacy barrier is received within said U-shaped rail when said privacy barrier is stores inside said side panel.

8. The dynamic privacy barrier system according to claim 2, wherein said handle and said supporting base are formed as a single-piece element.

9. The dynamic privacy barrier system according to claim 1, wherein said privacy barrier is pivotally moved within an angular range of 100°.

10. The dynamic privacy barrier system according to claim 2, wherein said handle and said supporting base are horizontally rotated within a range of 90°.

11. The dynamic privacy barrier system according to claim 2, wherein said handle and said supporting base are rotated so that said latching detent abuts against an edge of said privacy barrier once the privacy barrier is pivotally moved out of said side panel.

12. The dynamic privacy barrier system according to claim 2, wherein said handle and said supporting base are rotated so that said latching detent abuts against the detent of said privacy barrier once the privacy barrier is pivotally moved out of said side panel.

13. The dynamic privacy barrier system according to claim 1, wherein said privacy barrier further comprises a grabbing portion to assist a user in pivotally moving said side panel.

14. The dynamic privacy barrier system according to claim 13, wherein said grabbing portion comprises at least one of: a protruding tab or an indented cavity.

15. The dynamic privacy barrier system according to claim 1, wherein the side panel is made of at least one of: metal, wood, or plastic.

16. The dynamic privacy barrier system according to claim 1, wherein the side panel and the privacy barrier are made of at least one of: metal, wood, or plastic.

17. The dynamic privacy barrier system according to claim 1, further comprising a second side panel coupled to a side of another seat positioned adjacent to said seat, said second side panel including a second privacy barrier positioned inside the second side panel, the second privacy barrier having a second pivoting arrangement coupled to an interior wall of said second side panel; a second latching mechanism coupled to said second side panel, wherein said second privacy barrier is locked at a retracted position by said second latching mechanism once the second privacy barrier is pivotally moved out of said second side panel.

18. The dynamic privacy barrier system according to claim 17, wherein said second side panel is positioned between said seat and said another seat.

19. The dynamic privacy barrier system according to claim 17, wherein said second side panel is positioned at a side opposite to a common side of said seat and said another seat.

* * * * *